US007099613B2

(12) United States Patent
Nakamura et al.

(10) Patent No.: US 7,099,613 B2
(45) Date of Patent: Aug. 29, 2006

(54) DEVELOPING ROLLER, ELECTROPHOTOGRAPHIC PROCESS CARTRIDGE, AND ELECTROPHOTOGRAPHIC IMAGE FORMING APPARATUS

(75) Inventors: Minoru Nakamura, Shizuoka (JP); Arihiro Yamamoto, Shizuoka (JP); Kazutoshi Ishida, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/960,067

(22) Filed: Oct. 8, 2004

(65) Prior Publication Data

US 2005/0078987 A1 Apr. 14, 2005

(30) Foreign Application Priority Data

Oct. 14, 2003 (JP) ..... 2003-353934

(51) Int. Cl.
*G03G 15/08* (2006.01)

(52) U.S. Cl. ..... 399/286; 399/279

(58) Field of Classification Search ..... 399/279–286
See application file for complete search history.

(56) References Cited

U.S. PATENT DOCUMENTS 5,235,387 A * 8/1993 Sato et al. ..... 399/284
5,434,653 A 7/1995 Takizawa et al. ..... 399/284
5,587,776 A 12/1996 Watabe et al. ..... 399/284
5,689,783 A 11/1997 Sasame et al. ..... 399/284
5,729,806 A 3/1998 Niwano et al. ..... 399/284
5,893,013 A 4/1999 Kinoshita et al. ..... 399/284
5,895,150 A 4/1999 Watabe et al. ..... 399/284
5,933,692 A 8/1999 Niwano et al. ..... 399/284
5,978,636 A 11/1999 Yamamoto et al. ..... 399/284
6,094,555 A 7/2000 Katoh et al. ..... 399/284
6,393,243 B1 5/2002 Satoh et al. ..... 399/286

FOREIGN PATENT DOCUMENTS

JP 10-213965 8/1988
JP 02196242 A * 8/1990
JP 2000330374 A * 11/2000
JP 2001140854 A * 5/2001

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

In a developing roller having a shaft member, a conductive elastic layer provided on the shaft member, and a conductive resin layer constituting a most-surface layer, the conductive resin layer contains a condensed polycyclic organic pigment as exemplified by at least one selected from the group consisting of a quinacridone pigment, a threne pigment, a perylene pigment and a perinone pigment. The developing roller can effectively keep ghosts from occurring and can achieve high image density in a low-temperature and low-humidity environment.

7 Claims, 1 Drawing Sheet

DEVELOPING ROLLER, ELECTROPHOTOGRAPHIC PROCESS CARTRIDGE, AND ELECTROPHOTOGRAPHIC IMAGE FORMING APPARATUS

BACKGROUND OF THE INVENTION

1. Field of the Invention

This invention relates to a developing roller which is used in, e.g., electrophotographic apparatus such as copying machines and laser beam printers, and to an electrophotographic process cartridge and an electrophotographic image forming apparatus which make use of the developing roller.

2. Related Background Art

Conventionally, in electrophotographic apparatus or electrostatic recording apparatus, such as copying machines and laser beam printers, a pressure developing method is known as a developing method in which a non-magnetic one-component developer is fed to, e.g., a photosensitive drum which is holding a latent image thereon and the developer is made to adhere to the latent image (electrostatically charged image) on the photosensitive drum to render the latent image visible. According to this method, any magnetic material is not required, and hence the image forming apparatus can be made simple or compact with ease or toners can be made up as color toners with ease.

In this developing method, a developing roller holding a toner (non-magnetic one-component developer) thereon is brought into contact with a latent image bearing member holding an electrostatic latent image thereon, such as a photosensitive drum, to make the toner adhere to the latent image to perform development. Hence, the developing roller must be formed of a conductive elastic member. In recent years, the performance required of this developing roller has come very rich in variety. For example, as disclosed in Japanese Patent Application Laid-open No. H10-213965, it is proposed to add a charge control agent to an elastic layer of a single-layer roller formed of an elastic material.

However, where the non-magnetic one-component developer is used in conjunction with conventional developing rollers, it is difficult to control the charging of toner on the developing rollers, and problems concerning uniformity of charging and running stability of charging have not completely been solved, where image defects such as ghosts may occur. In this case, it is a difficult subject to obtain high-grade images that can achieve high image density especially in a low-temperature and low-humidity environment (15° C., 10% RH).

SUMMARY OF THE INVENTION

The present invention has been made taking into account the above-described subject. Accordingly, an object of the present invention is to provide a developing roller that can effectively keep ghosts from occurring and can achieve high image density in the low-temperature and low-humidity environment.

Another object of the present invention is to provide an electrophotographic process cartridge and an electrophotographic image forming apparatus that can effectively keep ghosts from occurring.

The present invention provides a developing roller having a shaft member, a conductive elastic layer provided on the shaft member, and a conductive resin layer constituting a most-surface layer, wherein the conductive resin layer contains a condensed polycyclic organic pigment.

In the present invention, the most-surface layer of the developing roller is covered with a conductive resin containing a condensed polycyclic organic pigment. This enables formation of high-grade images free of ghosts, and at the same time stabilization of the quantity of toner on the developing roller in the low-temperature and low-humidity environment to achieve proper image density.

DESCRIPTION OF THE PREFERRED EMBODIMENTS

The developing roller of the present invention is characterized in that it has a shaft member, a conductive elastic layer provided on the shaft member, and a conductive resin layer constituting a most-surface layer, and that the conductive resin layer contains a condensed polycyclic organic pigment.

It is preferable that the condensed polycyclic organic pigment is at least one selected from the group consisting of a quinacridone pigment, a threne pigment, a perylene pigment and a perinone pigment.

It is more preferable in the present invention that the condensed polycyclic organic pigment is contained in the conductive resin layer in an amount of from 1 to 40 parts by weight based on 100 parts by weight of the conductive resin.

It is further preferable in the present invention that the conductive elastic layer has an ASKER-C hardness of from 25° to 60°.

The present invention further provides an electrophotographic process cartridge set detachably mountable to the main body of an electrophotographic image forming apparatus, wherein the cartridge has a latent image bearing member and the developing roller described above.

The present invention still further provides an electrophotographic image forming apparatus having a latent image bearing member on which a latent image to be rendered visible by the use of a toner is formable, and a developing roller which holds the toner on its surface to form a toner thin layer thereon and feeds the toner from the toner thin layer to the latent image bearing member, wherein the developing roller is constituted as described above.

Figure 1:
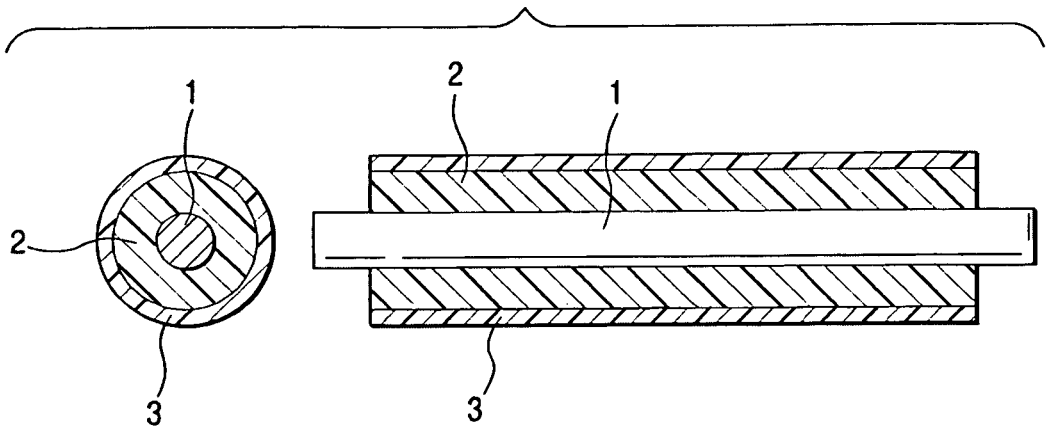
FIG. 1 is a sectional view showing the structure of the developing roller of the present invention.

The present invention is described below in greater detail. An example of the developing roller of the present invention is shown in FIG. 1. The developing roller shown in FIG. 1 is formed of a shaft 1 with good conductivity as a shaft member and provided on the periphery thereof a conductive elastic layer 2, which conductive elastic layer 2 is covered with a conductive resin to form a surface layer 3. More specifically, this surface layer (conductive resin layer) 3 is characterized by containing at least the conductive resin and the condensed polycyclic organic pigment. The conductive elastic layer 2 and the conductive resin layer 3 may each be in any number of layer(s), provided that at least the most-surface layer conductive resin layer 3 always contain the condensed polycyclic organic pigment.

Here, as the shaft 1 with good conductivity, any shaft may be used as long as it has a good conductivity. Usually used is a cylindrical member of 4 mm to 10 mm in external diameter, made of a metal such as aluminum, iron or stainless steel.

As the conductive elastic layer 2 formed on the periphery of this shaft 1, a layer may be used which is formed using as a base material an elastomer or foamed material of EPDM, urethane or the like, or other resin molded product, and, compounded therewith, an electron-conductive substance such as carbon black, a metal or a metal oxide or an ion-conductive substance such as sodium perchlorate to adjust resistivity to a suitable range of from $10^3$ to $10^{10}$ Ω·cm, and preferably from $10^4$ to $10^8$ Ω·cm. Here, the conductive elastic layer may preferably be formed in a hardness of from 25° to 60° as ASKER-C hardness. Inasmuch as it has the ASKER-C hardness of 25° or more, it cannot easily deform because of contact with a developing blade or a photosensitive drum, so that there can be no risk of causing horizontal lines due to such deformation to lower high-grade image quality. Also, inasmuch as it has the ASKER-C hardness of 60° or less, the melt adhesion of toner to the developing roller surface does not occur. The conductive elastic layer may also preferably have an ASKER-C hardness of from 35° to 55°, and more preferably from 40° to 50°.

Incidentally, the ASKER-C hardness referred to in the present invention is the hardness measured with an ASKER-C type spring-controlled rubber hardness meter (manufactured by Kobunshi Keiki Co., Ltd.) according to Japan Rubber Association Standard SRIS0101, and is the value measured 30 seconds after the above hardness meter is brought into contact with a roller on its middle at a force of 1 kg which has been left for 5 hours or more in an environment of normal temperature and normal humidity (23° C., 55% RH). The conductive elastic layer may preferably be in a thickness of from 1.0 mm to 8.0 mm. Inasmuch as it has a thickness within this range, the developing roller shows good elasticity, and restoration against deformation of the roller base material can be secured and stress against the toner can be lessened.

As the base material, it may specifically include polyurethane, natural rubber, butyl rubber, nitrile rubber, polyisoprene rubber, polybutadiene rubber, silicone rubber, styrene-butadiene rubber, ethylene-propylene rubber, ethylene-propylene-diene rubber, chloroprene rubber, acrylic rubber, and a mixture of any of these. Silicone rubber and EPDM may preferably be used. The use of silicone rubber or EPDM in the conductive elastic layer enables the developing roller to have a low hardness and be improved in wear resistance performance. Hence, the problem does not come about such that image quality may lower because of a lowering of wear resistance performance as a result of long-term service or that toner sealed portions at both ends of the roller may wear to cause toner leakage. Especially when silicone rubber is used in the conductive resin layer, the base material may include methylphenylsilicone rubber, fluorine-modified silicone rubber, polyether-modified silicone rubber and alcohol-modified silicone rubber. Any of these base materials may be used alone or in combination of two or more types as occasion calls.

As the electron-conductive material used to provide this conductive elastic layer 2 with conductivity, it may include conductive carbons such as KETJEN BLACK EC and acetylene black, rubber-purpose carbons such as SAF, ISAF, HAF, FEF, GPF, SRF, FT and MT, color(ink)-purpose carbon subjected to oxidation treatment or the like, metals such as copper, silver and germanium, and metal oxides of any of these. Any of these materials may be used alone or in combination of two or more types as occasion calls. In particular, carbon black is preferably used, as being readily conductivity-controllable in a small quantity. Any of these conductive powders may usually preferably be used in the range of from 0.5 to 50 parts by weight, and particularly from 1 to 30 parts by weight, based on 100 parts by weight of the base material.

To exemplify the ion-conductive substance used as the conductive material, usable are inorganic ion-conductive substances such as sodium perchlorate, lithium perchlorate, calcium perchlorate and lithium chloride, and also organic ion-conductive substances such as modified aliphatic dimethylammonium ethosulfate and stearylammonium acetate.

The surface layer 3 containing the conductive resin with which the conductive elastic layer 2 is covered further contains the condensed polycyclic organic pigment. This condensed polycyclic organic pigment is an organic pigment belonging to a group having different chemical structure from azo type or phthalocyanine type pigments, and has many types. They have various chemical structures, but are composed of condensed polycyclic compounds with aromatic rings or heterocyclic rings in common, having electronic specificity.

The condensed polycyclic organic pigment used in the present invention may specifically include, as a quinacridone type, C.I. Pigment Red 122, C.I. Pigment Violet 19, C.I. Pigment Red 202, C.I. Pigment Red 209, C.I. Pigment Red 207 and C.I. Pigment Red 206; as a threne type, C.I. Pigment Yellow 24, C.I. Pigment Yellow 108, C.I. Pigment Yellow 199, C.I. Pigment Yellow 147, C.I. Pigment Yellow 123, C.I. Pigment Orange 40, C.I. Pigment Red 168, C.I. Pigment Red 177, C.I. Pigment Blue 60, C.I. Pigment Blue 64 and C.I. Pigment Violet 31; as a Perylene type, C.I. Pigment Red 123, C.I. Pigment Red 190, C.I. Pigment Red 149, C.I. Pigment Red 178 and C.I. Pigment Red 179; as a Perinon type, C.I. Pigment Red 194 and C.I. Pigment Orange 43; as a dioxazine type, C.I. Pigment Violet 23 and C.I. Pigment Violet 37; as a quinophthalone type, C.I. Pigment Yellow 138; as an isoindolinone type, C.I. Pigment Yellow 109, C.I. Pigment Yellow 110, C.I. Pigment Orange 61 and C.I. Pigment Yellow 173; as an isoindoline type, C.I. Pigment Yellow 139; as a diketopyrrolopyrrole type, C.I. Pigment Red 255, C.I. Pigment Red 272 and C.I. Pigment Red 254, any of which may be used alone or in combination. In particular, quinacridone, threne, Perylene and Perinone pigments are particularly preferred as being capable of promoting the effect the developing roller of the present invention has. More preferably, threne pigments, Perylene pigments and Perinone pigments may be used. The use of these pigments enables formation of more high-grade images having high image density.

The condensed polycyclic organic pigment may also preferably be added to the most-surface layer in an amount of from 1 to 40 parts by weight based on 100 parts by weight of the resin. It may still also preferably be added in an amount of from 2 to 30 parts by weight, and more preferably from 3 to 15 parts by weight. Its addition in the amount of 1 part by weight or more enables sufficient achievement of high-grade image density in the low-temperature and low-humidity environment, and its addition in the amount of 40 part by weight or less enables formation of high-grade images without causing any horizontal lines due to developing blade contact marks.

The resin used to form the conductive resin layer may specifically include polyamide resin, urethane resin, urea resin, imide resin, melamine resin, fluorine resin, phenol resin, alkyd resin, silicone resin, polyester resin, polyether resin, and mixture of any of these. Any of these resins may be used alone or in combination of two or more types.

Forming the surface layer 3 by the use of urethane resin is preferable because the urethane resin has a high ability to charge the toner triboelectrically through the friction and also has wear resistance.

The developing roller of the present invention has such a conductive resin layer. This enables prevention of the occurrence of ghosts and formation of images having proper image density in the low-temperature and low-humidity environment. This is considered due to the fact that the balance of electrical characteristics has been optimized in virtue of the conductive elastic layer and the conductive resin layer having the condensed polycyclic organic pigment. Also, since the conductive elastic layer is covered and protected with the conductive resin layer, the developing roller can have high durability.

The conductive resin constituting this surface layer 3 may be made up by adding a conductive material to the above resin. As the conductive material, an electron-conductive material and an ion-conductive material may be used, for example. Any of these materials may be used alone or in combination of two or more types.

As the electron-conductive material, it may include conductive carbons such as KETJEN BLACK EC and acetylene black, rubber-purpose carbons such as SAF, ISAF, HAF, FEF, GPF, SRF, FT and MT, color(ink)-purpose carbon subjected to oxidation treatment or the like, metals such as copper, silver and germanium, and metal oxides of any of these. In particular, carbon black is preferably used, as being readily conductivity-controllable in a small quantity.

To exemplify the ion-conductive material, usable are inorganic ion-conductive materials such as sodium perchlorate, lithium perchlorate, calcium perchlorate and lithium chloride, and also organic ion-conductive materials such as modified aliphatic dimethylammonium ethosulfate and stearylammonium acetate.

In forming the surface layer 3, the conductive material may preferably be compounded in a proportion of from 1 to 50 parts by weight based on 100 parts by weight of the resin component. Then, in regard to the mixing and kneading of the resin, the condensed polycyclic organic pigment and the electron-conductive material or ion-conductive material, they may be mixed and stirred by means of, e.g., a ball mill, and roughness-providing particles for forming surface roughness of the developing roller may optionally appropriately be added and dispersed. Thereafter, a curing agent or a curing catalyst may be added, followed by stirring to obtain a coating composition, which may be coated by a method such as spraying or dipping. The conductive resin layer may preferably be in a thickness of from 1.0 μm to 30 μm, and more preferably from 3.0 μm to 20 μm. The conductive resin layer may also preferably be one having been adjusted to resistivity in the range of from $10^3$ to $10^8$ Ω·cm, and preferably from $10^4$ to $10^7$ Ω·cm.

The roughness-providing particles may include rubber particles of EPDM, NBR, SBR, CR, silicone rubber or the like; elastomer particles of thermoplastic elastomers (TPE) of polystyrene, polyolefin, polyvinyl chloride, polyurethane, polyester and polyamide types; or PMMA particles, urethane resin particles, and resin particles of fluorine resin, silicone resin, phenol resin, naphthalene resin, furan resin, xylene resin, divinylbenzene polymer, styrene-divinylbenzene copolymer, polyacrylonitrile resin or the like, any of which may be used alone or in combination. Here, the developing roller may thereby have a surface roughness Rz usually adjusted to from 1 μm to 15 μm, and preferably from 3 μm to 10 μm. Here, the surface roughness of the roller refers to the Rz according to JIS B 0601:2001.

Thus, in the manner as described above, the developing roller is obtained which is characterized by having the conductive elastic layer on the periphery of the shaft member and, covered thereon as the most-surface layer, the conductive resin containing the condensed polycyclic organic pigment.

The present invention further provides an electrophotographic process cartridge having at least a photosensitive drum and the developing roller.

Figure 2:
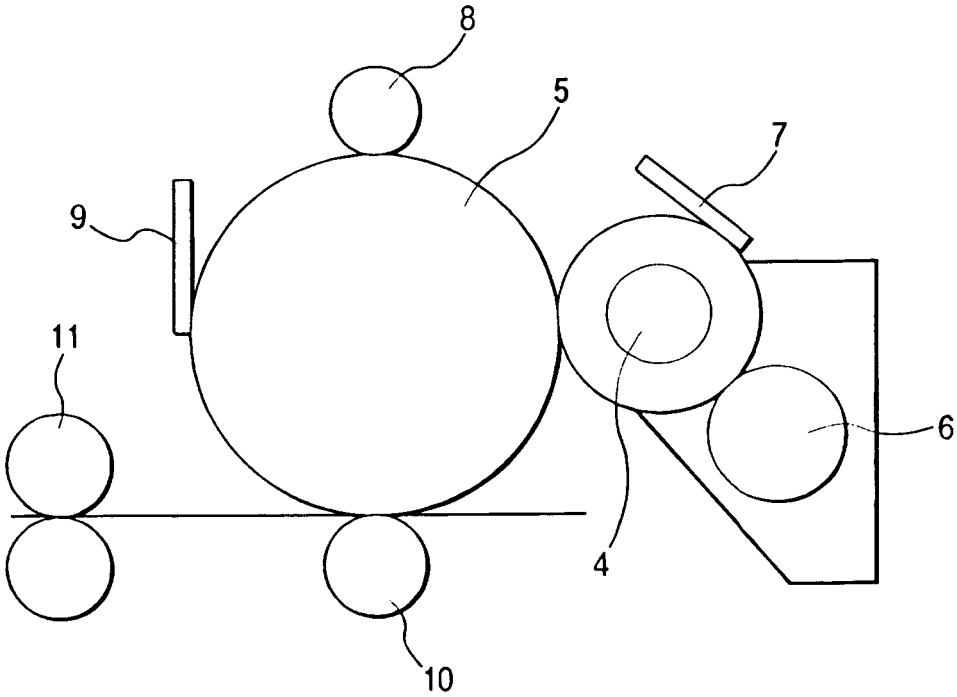
FIG. 2 is a diagrammatic view showing the constitution of a laser printer making use of the developing roller of the present invention.

The present invention also provides an electrophotographic image forming apparatus having the developing roller described above. More specifically, as shown in FIG. 2, the electrophotographic image forming apparatus consists basically of a toner coating roller 6 for feeding a toner, a charging roller 8 which charges a photosensitive drum 5 electrostatically, and a developing roller 4 which forms a toner image corresponding to an electrostatic latent image held on the photosensitive drum 5. The toner is fed to the surface of the developing roller 4 by means of the toner coating roller 6, and this toner is adjusted to a more uniform thin layer by means of a developing blade 7 which is a toner layer control member. In this state, the developing roller 4 is rotated in contact with the photosensitive drum 5, whereby the toner formed in thin layer moves from the developing roller 4 and adheres to the latent image held on the photosensitive drum 5, so that the latent image is rendered visible. In FIG. 2, reference numeral 10 denotes a transfer section, where the toner image is transferred to a recording medium such as paper; and 9, a cleaning blade, by means of which the toner remaining on the surface of the photosensitive drum 5 after transfer is removed. Also, in FIG. 2, reference numeral 11 denotes a fixing roller, which makes the toner image fixed to the recording medium such as paper by the action of heat and pressure.

EXAMPLES

The present invention is described below in greater detail by giving Examples and Comparative Examples. The following Examples by no means limit the present invention.

Example 1

A mandrel of 8 mm in outer diameter was concentrically set in a cylindrical mold of 16 mm in inner diameter, and, to form a conductive elastic layer, liquid conductive silicone rubber (a product available from Dow Corning Toray Silicone Co., Ltd.; ASKER-C hardness: 40°; volume resistivity: $10^7$ Ω·cm) was cast into it. Thereafter, this was put into a 130° C. oven, and was heated for 20 minutes to carry out molding. After demolding, the molded product was subjected to secondary vulcanization for 4 hours in a 200° C. oven to obtain a roller having a conductive elastic layer of 4 mm in thickness.

Next, a urethane coating material (trade name: NIPPOLAN N5037; available from Nippon Polyurethane Industry Co., Ltd.) was diluted with methyl ethyl ketone so as to be in a solid-matter concentration of 10%, and added thereto were carbon black (trade name: MA-230; available from Mitsubishi Chemical Corporation) as a conductive material in an amount of 15 parts by weight, C.I. Pigment Red 149 (available from Clariant AG) as a condensed polycyclic organic pigment in an amount of 15 parts by weight and PMMA particles (trade name: MX-1000H; available from Soken Chemical & Engineering Co., Ltd.) as roughness-providing particles in an amount of 12 parts by weight, all based on 100 parts by weight of the solid matter. These were stirred and dispersed by means of a ball mill, and thereafter a curing agent (trade name: COLONATE L; available from Nippon Polyurethane Industry Co., Ltd.) was added in an amount of 10 parts by weight based on 100 parts by weight of the urethane coating material (having not been diluted), followed by stirring to make up a coating preparation. With this coating preparation, the roller molded previously was coated thereon by dipping so as to be in a layer thickness of 15 μm, and this was dried for 15 minutes in a 80° C. oven, followed by curing for 4 hours in a 140° C. oven to obtain a developing roller. The developing roller obtained had a surface roughness Rz of 5.2 μm.

Example 2

A developing roller was obtained in the same manner as in Example 1 except that the condensed polycyclic organic pigment was changed to C.I. Pigment Blue 60 (available from Ciba Specialty Chemicals.). The developing roller obtained had a surface roughness Rz of 5.4 μm.

Example 3

A developing roller was obtained in the same manner as in Example 1 except that the condensed polycyclic organic pigment was changed to C.I. Pigment Violet 19 (available from Ciba Specialty Chemicals.). The developing roller obtained had a surface roughness Rz of 5.2 μm.

Example 4

A developing roller was obtained in the same manner as in Example 1 except that the condensed polycyclic organic pigment was changed to C.I. Pigment Orange 43 (available from Clariant AG). The developing roller obtained had a surface roughness Rz of 5.1 μm.

Example 5

A developing roller was obtained in the same manner as in Example 1 except that the condensed polycyclic organic pigment was changed to C.I. Pigment Violet 23 (available from Ciba Specialty Chemicals.). The developing roller obtained had a surface roughness Rz of 5.2 μm.

Example 6

A developing roller was obtained in the same manner as in Example 1 except that, as the condensed polycyclic organic pigment to be added, C.I. Pigment Red 149 (available from Clariant AG) was added in an amount of 1 part by weight. The developing roller obtained had a surface roughness Rz of 5.1 μm.

Example 7

A developing roller was obtained in the same manner as in Example 1 except that, as the condensed polycyclic organic pigment to be added, C.I. Pigment Red 149 (available from Clariant AG) was added in an amount of 40 parts by weight. The developing roller obtained had a surface roughness Rz of 5.2 μm.

Example 8

A developing roller was obtained in the same manner as in Example 1 except that, as the condensed polycyclic organic pigment to be added, C.I. Pigment Red 149 (available from Clariant AG) was added in an amount of 0.5 parts by weight. The developing roller obtained had a surface roughness Rz of 5.3 μm.

Example 9

A developing roller was obtained in the same manner as in Example 1 except that, as the condensed polycyclic organic pigment to be added, C.I. Pigment Red 149 (available from Clariant AG) was added in an amount of 50 parts by weight. The developing roller obtained had a surface roughness Rz of 5.1 μm.

Example 10

A developing roller was obtained in the same manner as in Example 1 except that, to form the elastic layer, liquid conductive silicone rubber (a product available from Dow Corning Toray Silicone Co., Ltd.; ASKER-C hardness: 25°; volume resistivity: $10^7$ Ω·cm) was used. The developing roller obtained had a surface roughness Rz of 5.1 μm.

Example 11

A developing roller was obtained in the same manner as in Example 1 except that, to form the elastic layer, liquid conductive silicone rubber (a product available from Dow Corning Toray Silicone Co., Ltd.; ASKER-C hardness: 60°; volume resistivity: $10^7$ Ω·cm) was used. The developing roller obtained had a surface roughness Rz of 5.1 μm.

Example 12

A developing roller was obtained in the same manner as in Example 1 except that, to form the elastic layer, liquid conductive silicone rubber (a product available from Dow Corning Toray Silicone Co., Ltd.; ASKER-C hardness: 20°; volume resistivity: $10^7$ Ω·cm) was use. The developing roller obtained had a surface roughness Rz of 5.2 μm.

Example 13

A developing roller was obtained in the same manner as in Example 1 except that, to form the elastic layer, liquid conductive silicone rubber (a product available from Dow Corning Toray Silicone Co., Ltd.; ASKER-C hardness: 70°; volume resistivity: $10^7$ Ω·cm) was used. The developing roller obtained had a surface roughness Rz of 5.1 μm.

Comparative Example 1

A developing roller was obtained in the same manner as in Example 1 except that the condensed polycyclic organic pigment was not added. The developing roller obtained had a surface roughness Rz of 5.3 μm.

Comparative Example 2

A mandrel of 8 mm in outer diameter was concentrically set in a cylindrical mold of 16 mm in inner diameter, and, to form an elastic layer, liquid conductive silicone rubber (a product available from Dow Corning Toray Silicone Co., Ltd.; ASKER-C hardness: 60°; volume resistivity: $10^7$ Ω·cm) in which 20 parts by weight of C.I. Pigment Violet 19 (available from Ciba Specialty Chemicals.) was dispersed was cast into it. Thereafter, this was put into a 130° C. oven, and was heated for 20 minutes to carry out molding. After demolding, the molded product was subjected to secondary vulcanization for 4 hours in a 200° C. oven to obtain a roller having a conductive elastic layer of 4 mm in thickness. Thereafter, the roller surface was polished to obtain a developing roller. The developing roller obtained had a surface roughness Rz of 5.3 μm.

Comparative Example 3

A developing roller was obtained in the same manner as in Example 1 except that, in place of the condensed polycyclic organic pigment, 3 parts by weight of BONTRON N-01 (available from Orient Chemical Industries, Ltd.) was added as a Nigrosine-base azine compound. The developing roller obtained had a surface roughness Rz of 5.0 μm.

Image Evaluation

The above-described developing rollers were each set in an electrophotographic process cartridge, and images were reproduced using a color laser printer (trade name: COLOR LASER JET 4600; manufactured by Hewlett-Packard Company) to make image evaluation. As a toner, a magenta toner of 7.0 μm in number-average particle diameter was used. The number-average particle diameter of the toner is the value measured with a laser diffraction type particle size analyzer, Coulter LS-130 (manufactured by Beckman Coulter Inc.), and calculated from number distribution.

Evaluation on Ghost Images:

To make evaluation on ghost images caused by the developing roller, images were continuously formed in a print percentage of 2% in a low-temperature and low-humidity environment (15° C., 10% RH). After 10,000-sheet image reproduction, a ghost judgement pattern (a pattern in which a solid image of 15 mm square and a halftone image are consecutively formed in one image sheet) was formed. On the ghost judgement pattern thus formed, whether or not image density was non-uniform in the halftone area was visually evaluated to make a judgement according to the following criteria.

A: No density non-uniformity is seen at all.

C: Density non-uniformity appears clearly on images, having a problem in practical use.

Solid-Image Density Evaluation:

To evaluate solid-image density in using the developing roller, images were reproduced in a low-temperature and low-humidity environment (L/L; 15° C., 10% RH). Here, initial-stage solid images were reproduced, and densities of solid areas were measured at nine spots, using a reflection densitometer RD918 (manufactured by Macbeth Co.). An average value thereof was regarded as image density. Usually, in the low-temperature and low-humidity environment, the solid-image density at the initial stage is 1.3 or more, which is preferable for high-grade images, and is more preferably 1.35 or more.

Toner Melt Adhesion:

To make evaluation on melt adhesion of toner to the developing roller, images were reproduced on 10,000 sheets in a normal-temperature and normal-humidity environment (23° C., 55% RH). Thereafter, whether or not the melt adhesion of toner was seen on the developing roller was judged according to the following criteria.

A: No melt adhesion of toner is seen at all.

B: Melt adhesion of toner is seen on some part of the roller, but no problem in practical use.

Horizontal Lines Due to Blade Contact Marks:

To make evaluation on horizontal lines due to blade contact marks on the developing roller, the electrophotographic process cartridge having the developing roller was left for a week in a high-temperature and high-humidity environment (40° C., 95% RH), and thereafter solid images were reproduced in the normal-temperature and normal-humidity environment. Whether or not the horizontal lines due to blade contact marks were seen was judged according to the following criteria.

A: No horizontal lines are seen at all.

B: Horizontal lines are slightly seen, but no problem in practical use.

The results of evaluation on each roller are shown in Table 1.

TABLE 1

Results of Image Evaluation

| | Condensed polycyclic organic pigment | Surface roughness Rz (μm) | Ghost | Image density in L/L | Toner melt adhesion | Horizontal lines due to blade contact marks |
|---|---|---|---|---|---|---|
| Example: | | | | | | |
| 1 | Perylene type | 5.2 | A | 1.42 | A | A |
| 2 | Threne type | 5.4 | A | 1.41 | A | A |
| 3 | Quinacridone type | 5.2 | A | 1.43 | A | A |
| 4 | Perinone type | 5.1 | A | 1.43 | A | A |
| 5 | Dioxazine type | 5.2 | A | 1.40 | A | A |
| 6 | Perylene type | 5.1 | A | 1.35 | A | A |
| 7 | Perylene type | 5.2 | A | 1.42 | A | A |
| 8 | Perylene type | 5.3 | A | 1.32 | A | A |
| 9 | Perylene type | 5.1 | A | 1.41 | A | B |
| 10 | Perylene type | 5.1 | A | 1.40 | A | A |
| 11 | Perylene type | 5.1 | A | 1.41 | A | A |
| 12 | Perylene type | 5.2 | A | 1.40 | A | B |
| 13 | Perylene type | 5.1 | A | 1.42 | B | A |

TABLE 1-continued

Results of Image Evaluation

| | Condensed polycyclic organic pigment | Surface roughness Rz (μm) | Ghost | Image density in L/L | Toner melt adhesion | Horizontal lines due to blade contact marks |
|---|---|---|---|---|---|---|
| Comparative Example: | | | | | | |
| 1 | — | 5.3 | C | 1.25 | A | A |
| 2 | Quinacridone type | 5.3 | C | 1.23 | A | B |
| 3 | — | 5.0 | C | 1.26 | A | A |

As is clear form the results shown in Table 1 on Examples 1 to 13, the developing roller characterized by having the conductive elastic layer on the periphery of the shaft member and, covered thereon as the most-surface layer, the conductive resin containing the condensed polycyclic organic pigment can effectively keep the ghosts from occurring, can achieve high image density in the low-temperature and low-humidity environment, and can provide high-grade images. In Example 13, the hardness of the base layer was higher than 60°, and hence the melt adhesion of toner was somewhat seen on the roller surface after running. However, a very good image level was achievable in regard to ghosts and image density. In Examples 9 and 12, the amount of the condensed polycyclic organic pigment added to the most-surface layer of the roller was more than 40 parts by weight or the hardness of the base layer was lower than 25°, and hence the developing roller contact marks slightly appeared as horizontal lines. However, a high-grade image level was achievable in regard to ghosts and image density. In Comparative Examples 1 and 3, though having a conductive elastic layer and surface layer double-layer structure, the condensed polycyclic organic pigment was not added to the most-surface layer of the roller, and hence ghosts seriously occurred and the image density in the low-temperature and low-humidity environment was not achievable, where no satisfactory results were obtainable. In Comparative Example 2, which was a single-layer roller having only an elastic layer, the ghost-preventive performance or high image density in the low-temperature and low-humidity environment as in the developing roller constituted according to the present invention were not achievable. Also, the horizontal lines due to blade contact marks appeared slightly.

This application claims priority from Japanese Patent Application No. 2003-353934 filed on Oct. 14, 2003, which is hereby incorporated by reference herein.

What is claimed is:

1. A developing roller comprising:

a shaft member, a conductive elastic layer provided on the shaft member; and a conductive resin layer constituting a most-surface layer, wherein said conductive elastic layer contains a silicon rubber;

said conductive resin layer contains a urethane resin and a condensed polycyclic organic pigment; and said condensed polycyclic organic pigment is at least one selected from the group consisting of C.I. Pigment Red 149, C.I. Pigment Blue 60 and C.I. Pigment Orange 43.

2. The developing roller according to claim 1, wherein said conductive resin layer contains said condensed polycyclic organic pigment in an amount of from 1 part by weight to 40 parts by weight based on 100 parts by weight of the resin.

3. The developing roller according to claim 1, wherein said conductive elastic layer has an ASKER-C hardness of from 25° to 60°.

4. An electrophotographic process cartridge set detachably mountable to the main body of an electrophotographic image forming apparatus, wherein;

said cartridge has a latent image bearing member and the developing roller according to any one of claims 1, 2 and 3.

5. The electrophotographic process cartridge according to claim 4, wherein said developing roller is provided in contact with said latent image bearing member.

6. An electrophotographic image forming apparatus comprising:

a latent image bearing member on which a latent image to be rendered visible by the use of a toner is formable; and a developing roller which holds the toner on its surface to form a toner thin layer thereon and feeds the toner from the toner thin layer to the latent image bearing member, wherein said developing roller is the developing roller according to any one of claims 1, 2 and 3.

7. The electrophotographic image forming apparatus according to claim 6, wherein said developing roller is provided in contact with said latent image bearing member.

* * * * *

UNITED STATES PATENT AND TRADEMARK OFFICE

CERTIFICATE OF CORRECTION

PATENT NO. : 7,099,613 B2
APPLICATION NO. : 10/960067
DATED : August 29, 2006
INVENTOR(S) : Minoru Nakamura et al.

It is certified that error appears in the above-identified patent and that said Letters Patent is hereby corrected as shown below:

TITLE PAGE AT ITEM (56) RC:
Foreign Patent Documents:

"02196242 A" should read --2-196242 A--.
"2000330374 A" should read --2000-330374 A--.
"2001140854 A" should read --2001-140854 A--.

COLUMN 2:
Line 27, "is" should read --be--.
Line 31, "is" should read --be--.
Line 36, "has" should read --have--.

COLUMN 4:
Line 61, "part" should read --parts--.

COLUMN 7:
Line 22, "Chemicals.)." should read --Chemicals).--.
Line 30, "Chemicals.)." should read --Chemicals).--.
Line 47, "Chemicals.)." should read --Chemicals).--.

COLUMN 8:
Line 43, "use." should read --used.--.

COLUMN 9:
Line 3, "Chemicals.)." should read --Chemicals).--.

COLUMN 11:
Line 16, "form" should read --from--.

UNITED STATES PATENT AND TRADEMARK OFFICE

CERTIFICATE OF CORRECTION

PATENT NO. : 7,099,613 B2
APPLICATION NO. : 10/960067
DATED : August 29, 2006
INVENTOR(S) : Minoru Nakamura et al.

It is certified that error appears in the above-identified patent and that said Letters Patent is hereby corrected as shown below:

COLUMN 12:
Line 34, "wherein; ¶" should read --¶ wherein--.

Signed and Sealed this

Twenty-second Day of May, 2007

JON W. DUDAS
*Director of the United States Patent and Trademark Office*